US005320288A

United States Patent [19]

Ketcham, Jr.

[11] Patent Number: 5,320,288

[45] Date of Patent: Jun. 14, 1994

[54] HOSE-END SPRAYING APPARATUS

[75] Inventor: E. Lee Ketcham, Jr., Bedford, Pa.

[73] Assignee: Green Garden, Inc., Somerset, Pa.

[21] Appl. No.: 66,767

[22] Filed: May 24, 1993

[51] Int. Cl.[5] ..... B05B 7/30

[52] U.S. Cl. ..... 239/316; 239/310; 239/586; 239/581.1; 222/484; 137/894

[58] Field of Search ..... 239/310, 315, 316, 317, 239/569, 586, 581.1; 222/630, 484, 561; 137/893, 894, 625.48; 251/326

[56] References Cited

U.S. PATENT DOCUMENTS

| | | | |
|---|---|---|---|
| 949,974 | 2/1910 | Cibulka | 222/561 |
| 1,847,703 | 3/1932 | Ullman | 222/484 |
| 3,185,352 | 5/1965 | Ghisolfi | 239/327 |
| 3,186,643 | 6/1965 | George et al. | 222/484 |
| 3,212,716 | 10/1965 | Mills et al. | 137/268 |
| 4,508,272 | 4/1985 | Thompson | 222/630 |
| 4,651,930 | 3/1987 | Magaha, Jr. | 137/894 |
| 4,832,231 | 5/1989 | Kolody | 222/484 |
| 5,100,059 | 3/1992 | Englhard et al. | 239/310 |

FOREIGN PATENT DOCUMENTS

| | | | |
|---|---|---|---|
| 856577 | 11/1970 | Canada | 222/484 |

*Primary Examiner*—Andres Kashnikow
*Assistant Examiner*—Christopher G. Trainor
*Attorney, Agent, or Firm*—Reed Smith Shaw & McClay

[57] ABSTRACT

A sprayer is provided for preferably permanent attachment to a container containing a chemical product to be diluted by a carrier stream. The sprayer comprises a nozzle member having a mechanism for attachment of the nozzle member to a source of the carrier stream. The nozzle member also includes a control mechanism for controlling flow of the carrier stream. The sprayer also includes a control member having a product aperture and an inlet or vent port disposed therein. The sprayer further comprises a cap member, including a means for attaching the cap member to the container. The cap member is slideably attached to the control member and includes a corresponding product channel and an inlet or vent channel. Preferably, the control member and the control mechanism for controlling the flow of the carrier fluid are operatively connected such that a single motion can simultaneously open or close both the flow of carrier fluid and the chemical product.

10 Claims, 17 Drawing Sheets

HOSE-END SPRAYING APPARATUS

FIELD OF THE INVENTION

The present invention relates to a hose-end spraying apparatus and especially to an aspiration type hose-end spraying apparatus and a wettable powder hose-end sprayer.

BACKGROUND OF THE INVENTION

Liquid aspirators are commonly employed to apply diluted solutions containing chemicals such as pesticides, fungicides, herbicides, and fertilizers to lawns or garden foliage. Typically, sprayers of this type are attached to a garden hose. The pressure of the water delivered through the hose creates a negative pressure gradient that causes a chemical solution to be aspirated into the water stream, thereby providing a diluted solution to be sprayed.

In general, aspiration sprayers include a container for holding the chemical solution to be diluted and sprayed and a sprayer/mixing head. The base portion of the sprayer head serves as a cover for the chemical container. Such sprayer heads generally include an adapter for connecting the sprayer head to a standard garden hose, and a hand valve for turning on and off the flow of water from the garden hose. The sprayer head also includes an aperture over which water from the garden hose passes to mix with undiluted chemical solution from the container. Such sprayer heads may also include a venturi chamber in which the water from the garden hose mixes with the chemical from the container.

In principle, as water passes over the aperture or through the venturi chamber, a siphoning or vacuum action, is created by virtue of the velocity of the water passing over the aperture or through the chamber, to draw chemical from the container into the water stream for dilution. The basis of operation of these sprayers is Bernoulli's principle. The effect is also referred to as the Kuanda effect.

In common use today are 28 mm. aspiration sprayers used by a number of manufacturers. Until recently, such units were shipped with the sprayer/mixing head attached to the side of the container of liquid chemical in some manner. Liquid in the container is contained by a standard "child-proof" cap. Before use, the consumer removes the cap, attaches the sprayer head and connects a garden hose.

When the product container is emptied, such removable sprayer heads can be removed and attached to another container. Although economically advantageous, removable sprayer heads introduce the potential of exposure of adults and especially children to concentrated chemical product. In many instances the contained product is a potentially hazardous chemical such as an insecticide or herbicide.

Within the past few years, however, new "on-the-bottle" units have entered the market. With on-the-bottle units, the consumer merely connects the unit to a hose and is ready to spray. Because on-the-bottle units are designed to be discarded once the attached product container is emptied, such units are preferably inexpensive to manufacture.

Generally, leakage of the potentially hazardous chemical product is possible through the product aperture and through a small air vent hole, each of which are necessary elements of any aspiration type sprayer.

Several manufacturers have introduced on-the-bottle units that are described as sufficiently sealed when not in use for safe shipment and storage.

U.S. Pat. No. 4,901,923, for example, discloses a variable dilution ratio hose-end aspirator sprayer. The sprayer comprises a container for housing the liquid to be mixed with the water and a mixing head having a nozzle at one end thereof and a garden hose attachment device at the other end thereof. The sprayer also includes a mixing chamber within the mixing head, a hose for communicating the liquid from the container to the mixing head and a disk having a plurality of apertures therein rotatably mounted in the mixing head to control flow from the container to the mixing chamber. A flow tube communicates liquid in the container to the inlet in the mixing chamber though a selected aperture in the disk so that the liquid is diluted with pressurized water at a dilution ratio determined by the size of the aperture aligned with the tube and the mixing chamber. The sprayer also includes a cleaning orifice positioned circumferentially from the mixing chamber so that each aperture of the disk may be selectively aligned with the cleaning orifice for cleaning.

U.S. Pat. No. 5,039,016 also discloses an aspiration-type chemical sprayer for dispensing small quantities of a liquid-based chemical into a stream of carrier fluid. The sprayer includes a sprayer head assembly sealingly mounted onto a container for storing the chemical to be disbursed. The sprayer head assembly also includes a multi-function unitary valve for providing a range of aspiration rates simultaneously with full communication of the container interior to atmospheric pressure. The valve may also include means for positive and simultaneous closure of the aspiration and vent passages so as to seal the chemical in the container when the sprayer is not in use.

U.S. Pat. No. 5,100,059 similarly discloses an aspiration-type chemical sprayer including a sprayer head assembly sealingly mounted onto a container holding chemicals such as pesticides or fertilizers. A unitary valve in the sprayer head assembly controls carrier fluid flow from a pressurized source of water while simultaneously providing a controlled aspiration rate and full communication of the container interior to atmospheric pressure. The valve additionally includes simultaneous closure of the carrier fluid, aspiration and vent passage ways so as to seal the chemical in the container when the sprayer is not being used.

U.S. Pat. No. 5,007,588 also discloses an aspiration-type sprayer comprising a sprayer head which is permanently attachable to a container in which additive material is received. The sprayer head may be moveable between positions controlling the degree of aspiration affected, and is provided with a cap moveable between a first position in which the cap seals the container and prevents the additive material from escaping therefrom and a second position in which the container is unsealed and aspiration of the contents thereof can take place. Elements may be provided as part of the sprayer assembly for controlling the flow of the aspirating fluid. The cap is secured in its sealing position by an element which require special manipulating for release, thereby providing an important safety feature.

Similarly, Green Sweep ® has recently introduced a sprayer in which a water shut-off valve is linked with the product aperture seals so that one rotational movement results in both water and product being released at the same time (or simultaneously shut off).

Although it is desirable to enable on/off control of both water inflow and product flow in a single movement, this feature hinders the ability to provide a short product channel as both the aperture for water flow and the product aperture must be close enough to the control cylinder to be within the diameter of the control cylinder. The product channel of the Green Sweep sprayer, for example, traverses two right angles before opening into the carrier stream, resulting in a product channel length of over one (1) inch.

The product channel (i.e., the passage through which the chemical to be diluted passes after leaving the container to reach the product aperture and enter the carrier stream) of aspiration type sprayers is generally formed during injection molding with the use of a pin of appropriate diameter. In sprayer head designs that are shipped disconnected from the product container, the product channel is relatively short and straight, essentially passing linearly through a thin plastic base or cap member. Such product channels are typically 3/16 inch in length. The increased complexity and extension of product channel (arising from both the requirement of appropriate sealing during nonuse in the case of on-the-bottle designs and attempts at single movement control) create the potential of significant reduction in quality. Slightly bent pins used to create the product passage or small pieces of flashing can create performance failures or even non-performance at water pressure levels under 20 PSI.

Although the feature of single-movement control has complicated prior sprayers as set forth above, absence of this feature creates the need for two control valves, which complicates consumer instruction and use, increases the potential for leakage and may increase manufacturing cost.

It is therefor desirable to develop an on-the-bottle sprayer capable of single-movement control in which the length of the product channel is substantially minimized and in which the product channel is substantially linear.

It is also desirable that such a sprayer be simple in operation and inexpensive to manufacture.

SUMMARY OF THE INVENTION

Accordingly the present invention provides an aspiration type sprayer for attachment to a container containing a chemical product to be diluted by a carrier stream. The sprayer comprises an upper or nozzle member having a means for attachment of the nozzle member to a source of the carrier stream. The nozzle member also includes a means for controlling flow of the carrier stream. The sprayer further comprises a control member in operative connection with the nozzle member. The control member includes a product aperture for communicative connection with the product container and an inlet or vent port for communicative connection with ambient pressure.

The sprayer further comprises a cap member, including a means for attaching the cap member to the container. The cap member includes a product channel and a vent channel. The cap member is slideably connected to the control member such that the control member can be longitudinally slid to a first position in which the product aperture and the vent port are in substantially linear communicative connection with the product channel and the vent channel, respectfully, thereby allowing the chemical to enter the carrier stream for dilution when the carrier stream passes over the product aperture. The cap member can also be slid to a second position in which the product aperture and the vent port are not in communicative connection with the product channel and the vent channel and the chemical is thereby substantially sealed within the container. Preferably, the control member and the means for controlling the flow of the carrier fluid are operatively connected such that a single motion can simultaneously open or close both the flow of carrier fluid and product chemical.

The present sprayer also preferably provides the ability to spray pure carrier fluid, that is the means for controlling the flow of carrier fluid can be opened while the chemical product is sealed within the container.

The longitudinally sliding operation of the control member in relation to the cap member of the present invention enables minimization of the length and the complexity of the product channels through which the chemical product must pass to reach the carrier stream as compared to previous on-the-bottle sprayer units. The present invention accomplishes this minimization, in part, by removing the constraint of previous single-rotational-movement sprayers that both the water aperture and the product aperture must be within reach of the diameter of a control cylinder. When the product channels of the present invention are aligned, as little as approximately 1.25 to 2.0 times the distance as required for previous removable sprayer units must be traversed. Preferably the distance is less than ½ inch.

More preferably the distance is less than ⅜ inch. Most preferably the distance is approximately ¼ inch. This is a substantial improvement over existing on-the-bottle designs which could only obtain such product channel lengths through use of two control valves. Moreover, this improvement is accomplished with a design which is less complex and thus more economically manufactured than existing designs.

The present invention is conformable to both 28 mm and 63 mm ("wide mouth") designs. Moreover, the present invention is also conformable to a 63 mm wettable powder unit. Such wettable powders, including the fertilizers Miracle Gro®, Peters®, Ortho® and K-Gro®, are almost always sold with "free" dry product inside a container. The water inlet and water/product outlet holes of wettable powder units must be sealed to prevent powder from escaping during shipment. Presently this sealing is accomplished by using a removable sealing tape or by hermetically sealing the entire lid before the sprayer is attached. In the off position of the present invention, however, powder cannot escape and removable seals are not necessary.

DETAILED DESCRIPTION OF THE INVENTION

Figure 1:
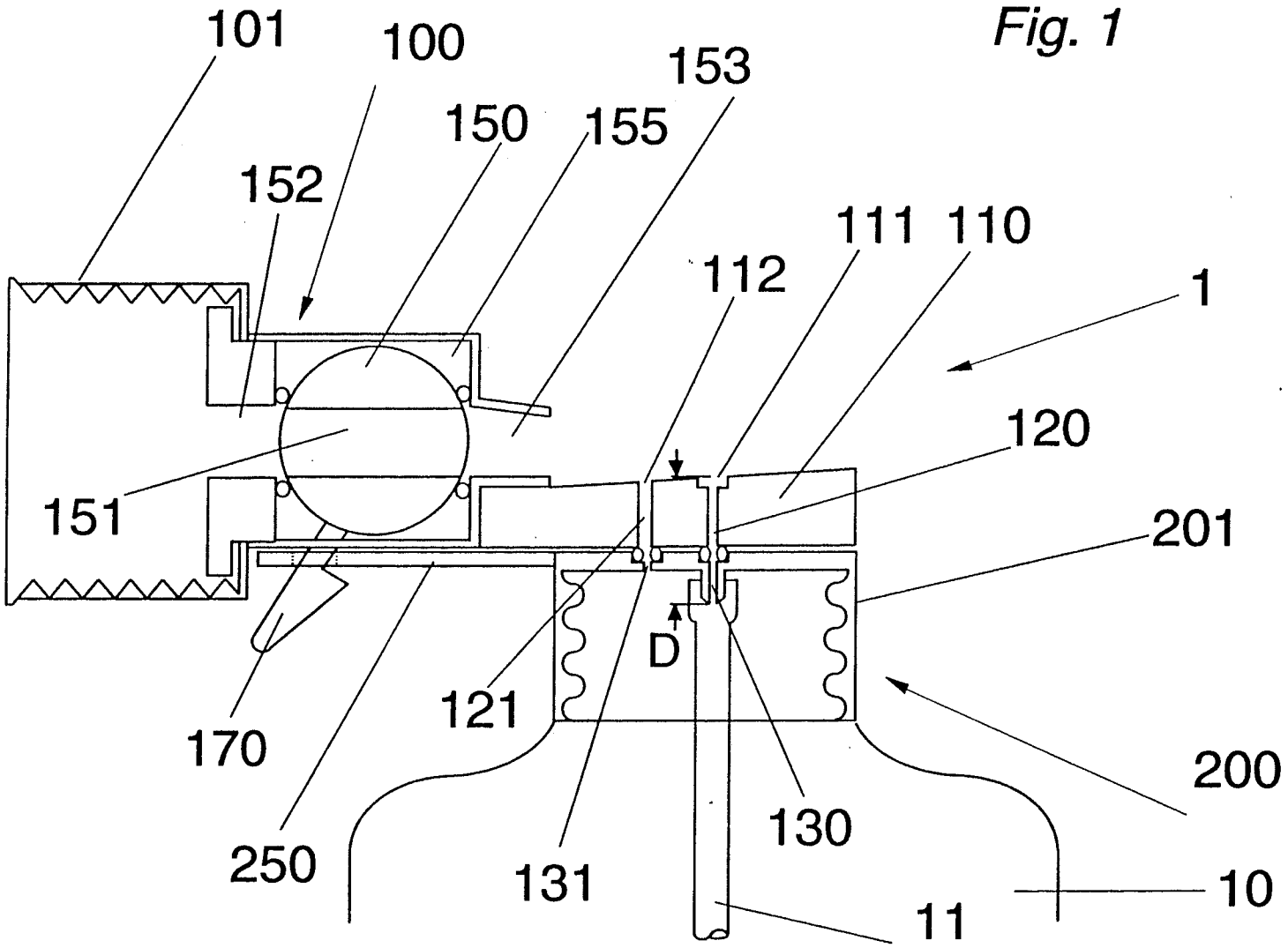
FIG. 1 is a side, cross-sectional view of an embodiment of a sprayer in a position in which both carrier fluid and chemical product flow are possible.
Figure 2:
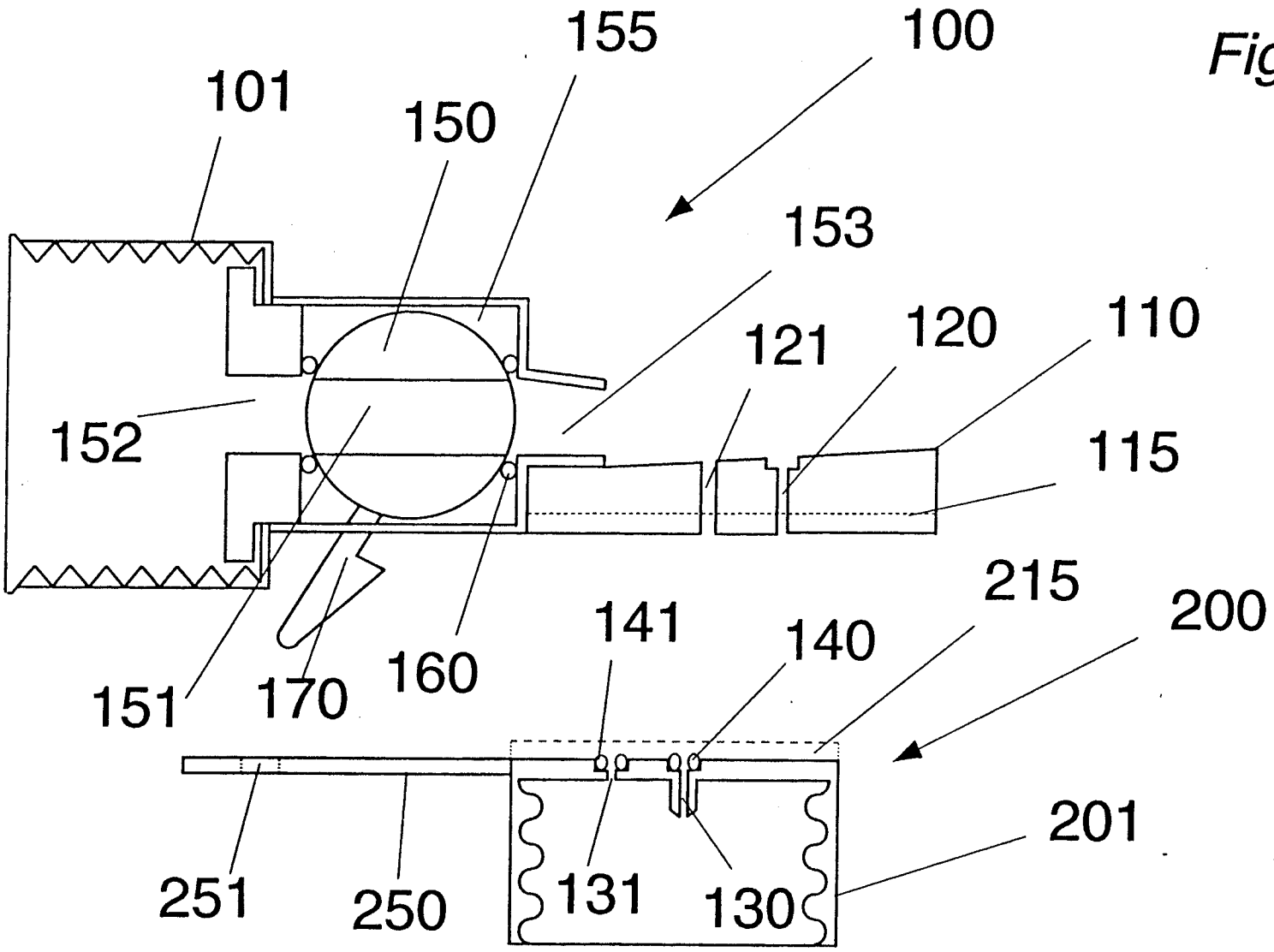
FIG. 2 is a side, cross-sectional view of the sprayer in which the nozzle member and the cap member are separated.

Referring to FIGS. 1 and 2, sprayer head 1 is generally comprised of an upper or nozzle member 100 and a lower or cap member 200. Nozzle member 100 includes a hose end attachment means 101. Cap member 200 includes a container attachment means 201. Container attachment means 201 is attachable to container 10, the interior of which is capable of holding a chemical product to be diluted and sprayed. Preferably, container attachment means 201 is permanently and sealingly attached to container 10. Hose end attachment means 101 is removably attachable to a hose end (not shown) for supply of a carrier stream of fluid. In most applications, the carrier stream fluid will be water supplied by a common garden hose (not shown).

Nozzle member 100 has preferably operatively connected thereto a control member 110 slideably disposed above container attachment means 201. Forwardly located control member 110 includes a product aperture 111 and an inlet or vent port 112 disposed therein.

Figure 9:
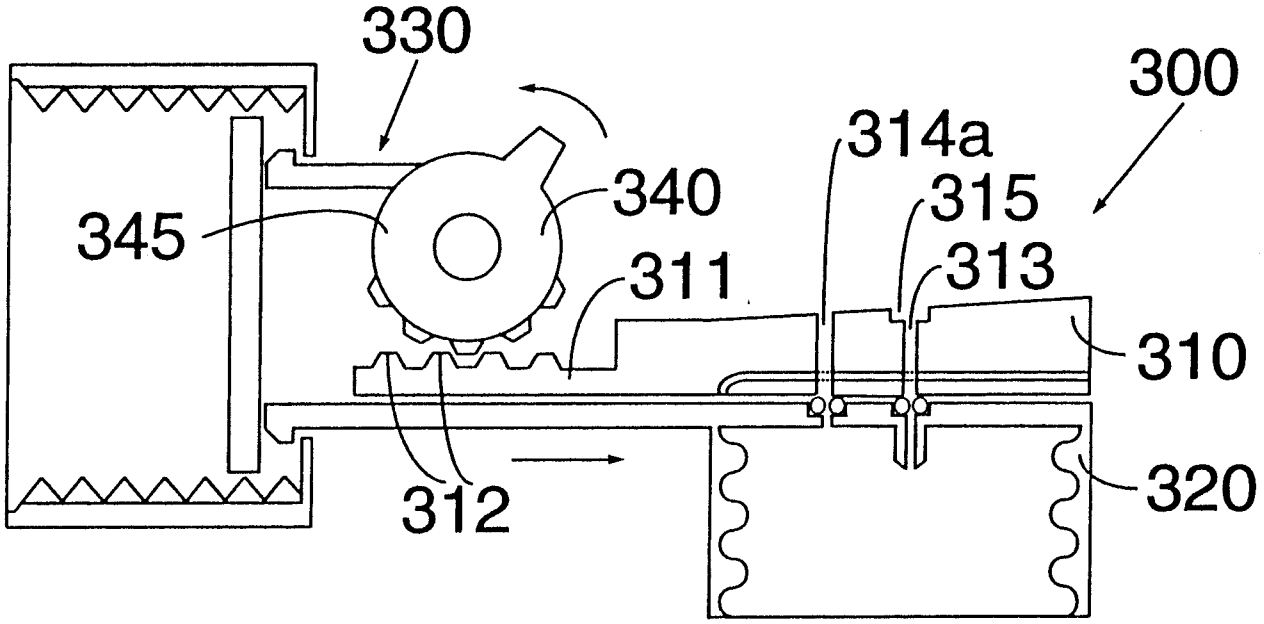
FIG. 9 is a side, cross-sectional view of an embodiment of a sprayer.

As illustrated graphically in FIGS. 1, 2, 3 and 4, control member 110 and cap member 200 are designed to be longitudinally, slideably connected. When control member 110 is in a first position as shown in FIG. 1, product channel 120 and vent channel 121 disposed in control member 110 are aligned respectively with a corresponding product channel 130 and a corresponding vent channel 131 disposed in container attachment means 201. As depicted in FIGS. 1, 2, 3 and 4, the nozzle member 100 and control member 110 are connected such that nozzle member 100 and control member 110 slide as a unit relative to cap member 200. It will be appreciated, however, that the invention may easily be modified such that control member 110 slides independently of the nozzle member 100 as shown in the embodiment of FIG. 9 discussed below.

Nozzle member 100 also includes a means for controlling flow of water from a hose attached thereto. Preferably, this means for controlling water flow may comprise a ball valve 150 disposed in a valve chamber 155. When in a first position as shown in FIG. 1, passage 151 in ball valve 150 is in communicative alignment with inlet means 152 disposed in hose attachment means 101 and outlet means 153.

Figure 7:
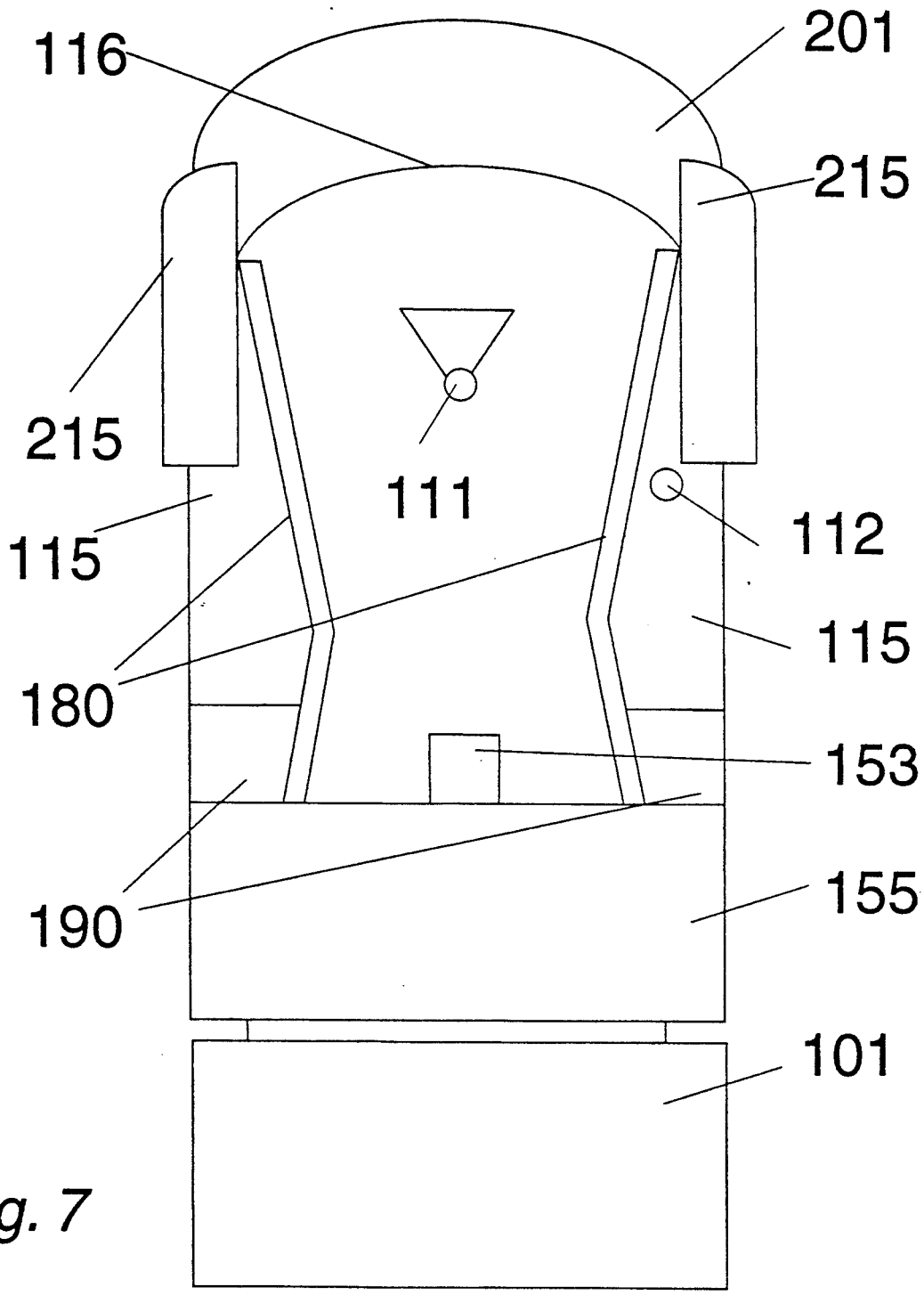
FIG. 7 is a top view of the sprayer in the off position.
Figure 8:
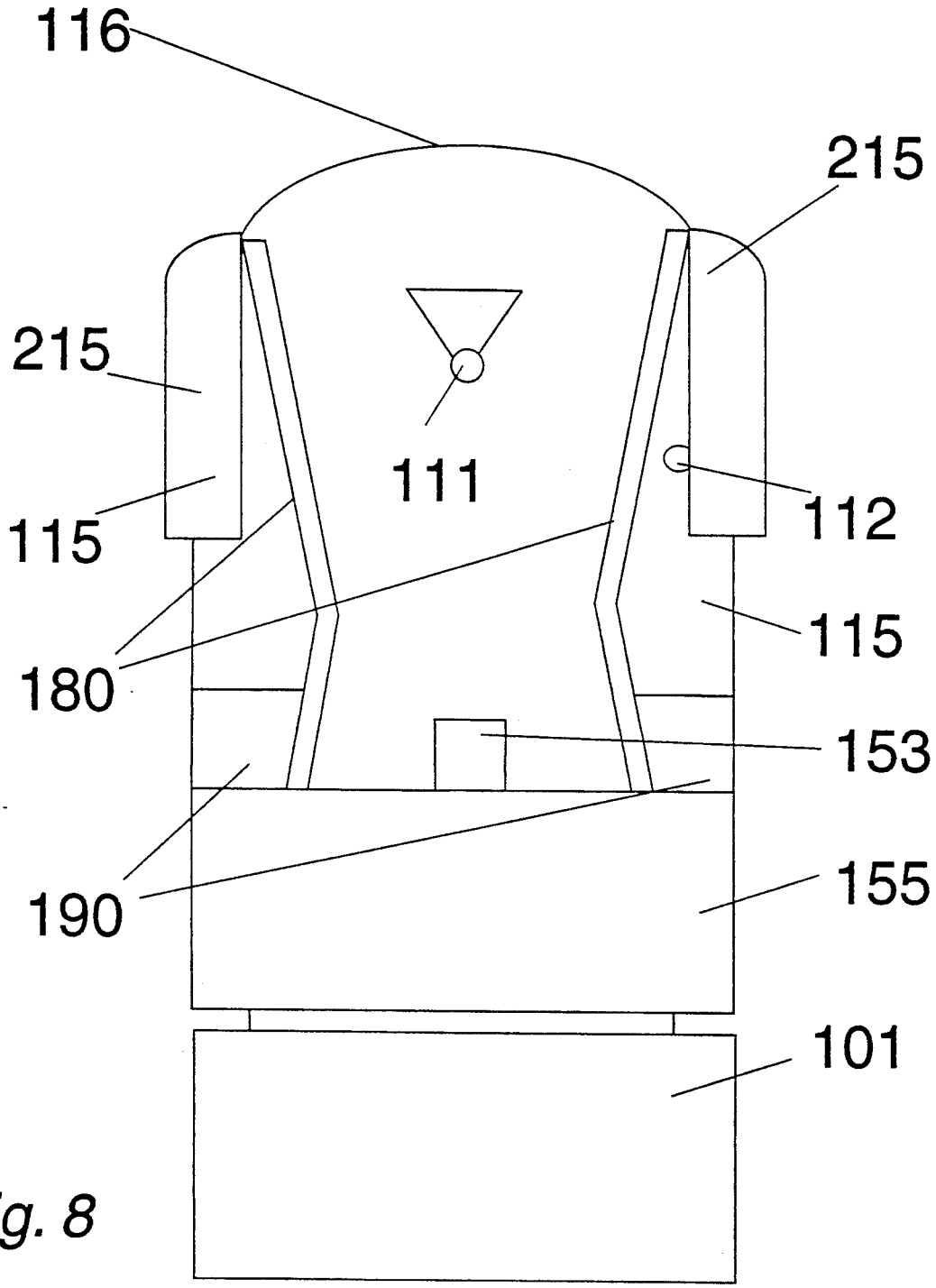
FIG. 8 is a top view of the sprayer in the on position.

In this first position water from a hose (not shown) flows through passage 151 and exits outlet means 153. Outlet means 153 is appropriately designed and positioned to direct the exiting stream of water over product aperture 111 (as best illustrated in FIGS. 7 and 8), thereby creating a negative pressure gradient and causing chemical product in the interior of container 10 to be drawn through a product tube 11, through product channels 130 and 120 respectively and out of product aperture 111 to be diluted by the carrier water stream. The chemical product is thus diluted by the water stream to substantially a desired concentration and sprayed onto a target such as a residential lawn or garden.

The substantially linear alignment of product channels 130 and 120 minimizes the distance the product must travel (i.e., the distance from the beginning of the product channel to exit at the product aperture, represented as product channel length D in FIG. 1) and greatly reduces the danger of faulty manufacture. In the present invention, the combined length D of product channels 130 and 120 is preferably less than $\frac{1}{2}$ inch. More preferably product channel length D is less than $\frac{3}{8}$ inch. Most preferably product channel length D is approximately $\frac{1}{4}$ inch.

Figure 3:
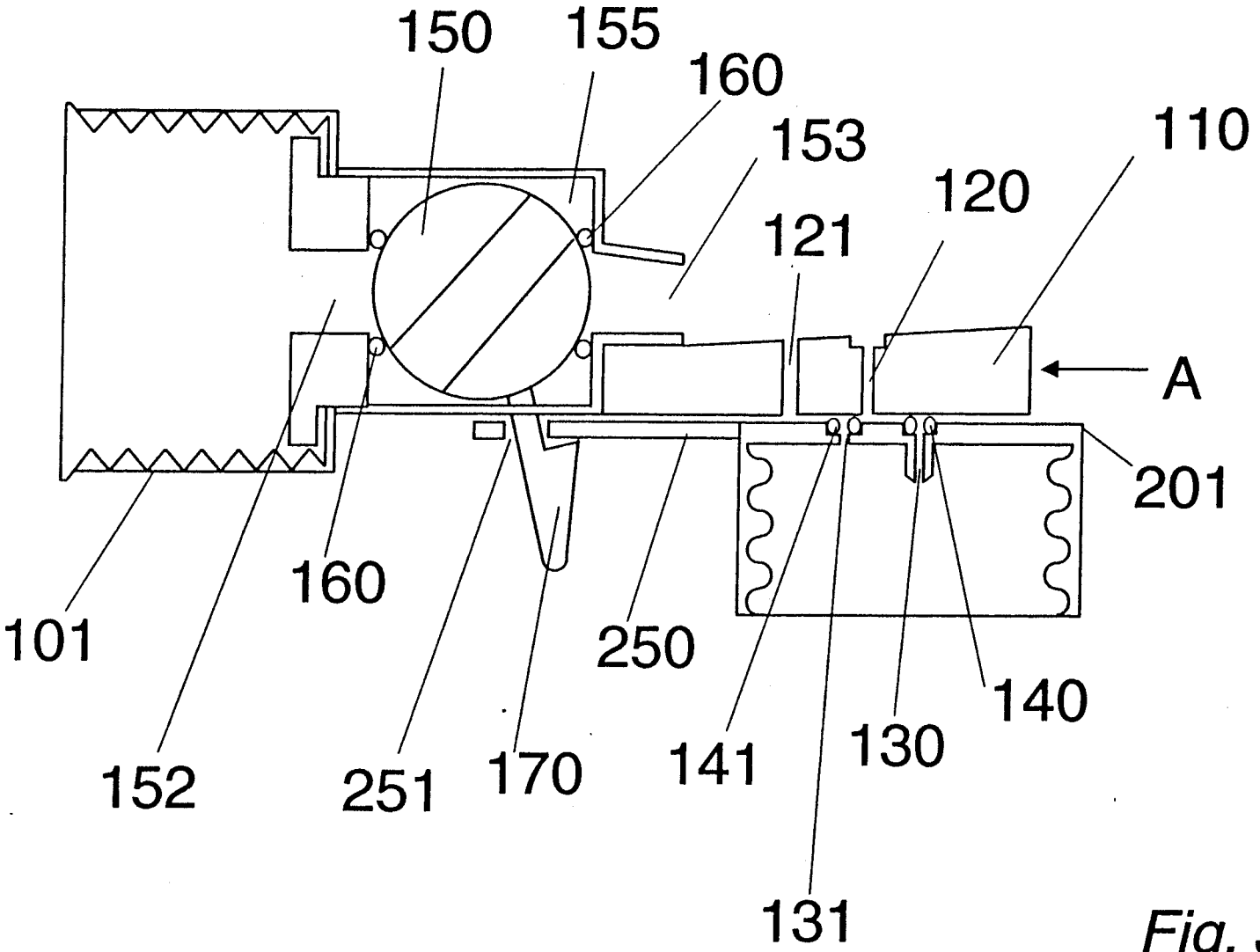
FIG. 3 is a side, cross-sectional view of the sprayer in a position in which neither carrier fluid flow nor chemical product flow is possible.

In a second position shown in FIG. 3, control member 110 has been slid longitudinally rearwards relative to cap member 200 as indicated by arrow A. Product channel 120 and 130 as well as vent channels 121 and 131 are no longer in alignment. Sealing means such as elastomeric rings 140 and 141 disposed between container attachment means 201 and control member 110 effectively seal the contents of container 10 and prevent leakage to the surrounding environment. Sealing means 140 and 141 are preferably disposed in well like depressions surrounding product channel 130 and vent channel 131, respectively.

As also illustrated in FIG. 3, ball valve 150 has been rotated so that passage 151 is no longer in alignment with inlet means 152 and outlet means 153, thereby shutting off the water flow. Ball valve sealing means such as O-rings 160 provide an effective seal to prevent water from flowing past or around ball valve 150.

In a preferred embodiment, ball valve 150 and control member 110 are interrelatedly and connectively operative via a connective means such that the relative sliding motion of control member 110 relative to cap member 200 simultaneously results in rotation of ball valve 150. This interrelated operation of ball valve 150 and control member 110 enables simultaneous opening and closing of water flow and product flow via a single controlled motion.

In this regard, cap member 200 may be provided with an extending connective member 250 extending rearwardly under nozzle member 100. Connective member 250 includes an opening 251 disposed therein. Ball valve 150 preferably includes a control means such as lever 170 in operative connection therewith to control the rotation of ball valve 150 and thereby the orientation of passage 151. Lever 170 is also in operative connection with connective member 250 via opening 251. By appropriate movement of lever 170, the position of ball valve 150 and the position of control member 110 relative to cap member 200 can be simultaneously controlled.

In this regard, when lever 170 is in its most rearward position as shown in FIG. 1, ball valve 150 is in the open position and control member 110 is positioned such that product channels 120 and 130 and vent channels 121 and 131 are in alignment (i.e., control member 110 is in the first position). When lever 170 is in its most forward position as shown in FIG. 3, ball valve 150 is in the closed position and control member 110 is positioned such that product channels 120 and 130 and vent channels 121 and 131 are misaligned and sealed (i.e., control member 110 is in the second position).

Figure 4:
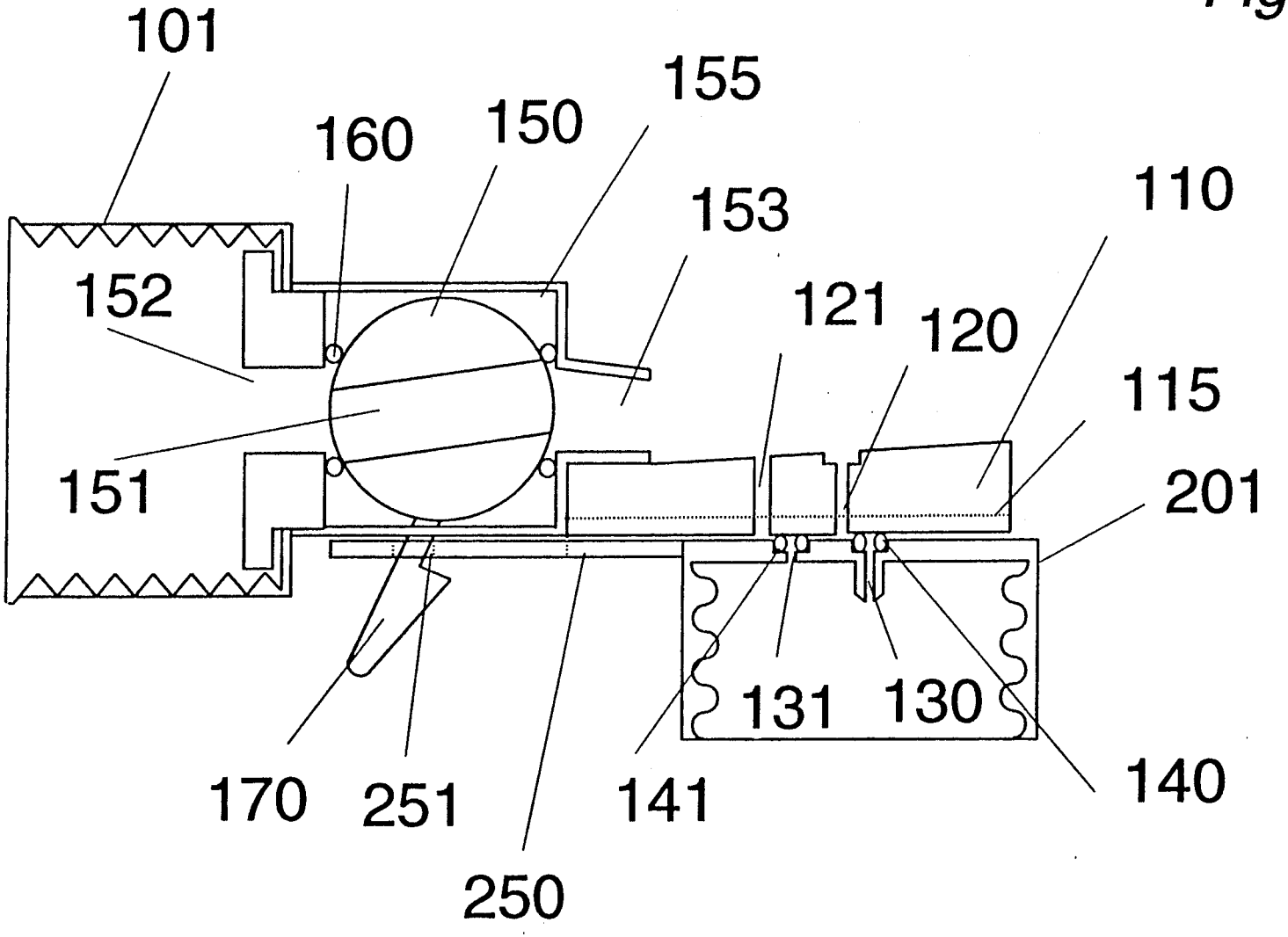
FIG. 4 is a side, cross-sectional view of the sprayer in a position in which carrier fluid flow is possible but chemical product flow is not possible.

Preferably, through appropriate positioning of product channel 120 and vent channel 121, a third intermediate position of control member 110 and ball valve 150 is possible wherein water may flow through ball valve 150 but the product in container 10 remains sealed therein. This third position as illustrated in FIG. 4, permits the user to rinse, clean, water or otherwise use substantially pure water without removing product container 10. The ability to spray water only is particularly attractive when using car wash, siding wash, or pet shampoos. In addition, it is frequently desirable to rinse plants with water prior to fertilization. Preferably, sprayer 1 is provided with an indicator thereon to notify the user of the position of sprayer 1 (i.e., (1) off, (2) spraying product or (3) spraying pure carrier stream).

Figure 5A:
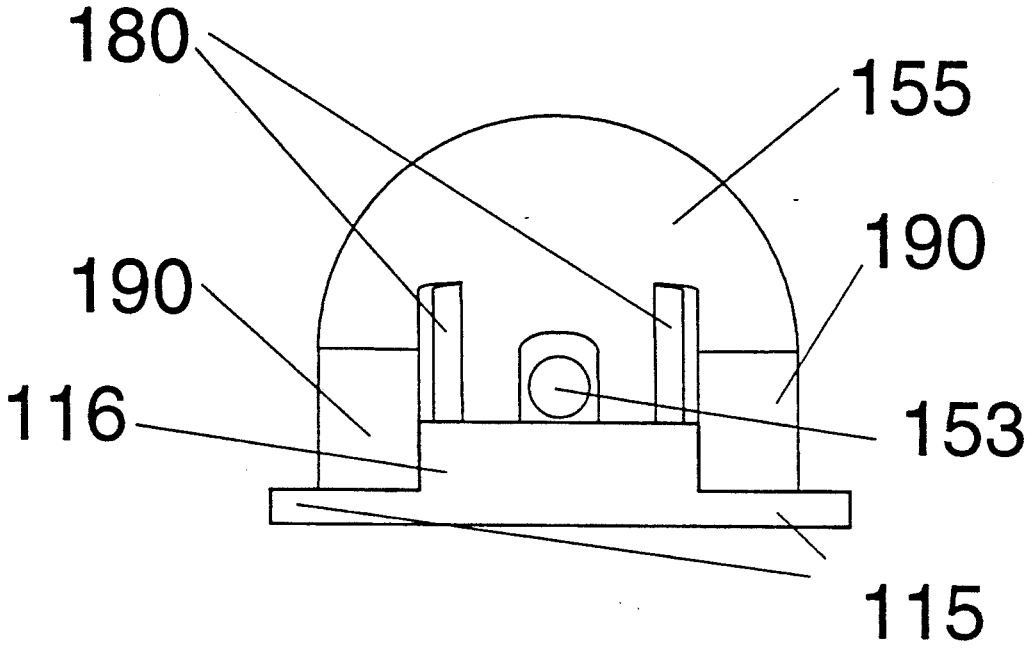
FIG. 5A is a front view of the nozzle member illustrating the planner tracks of the control member.
Figure 5B:
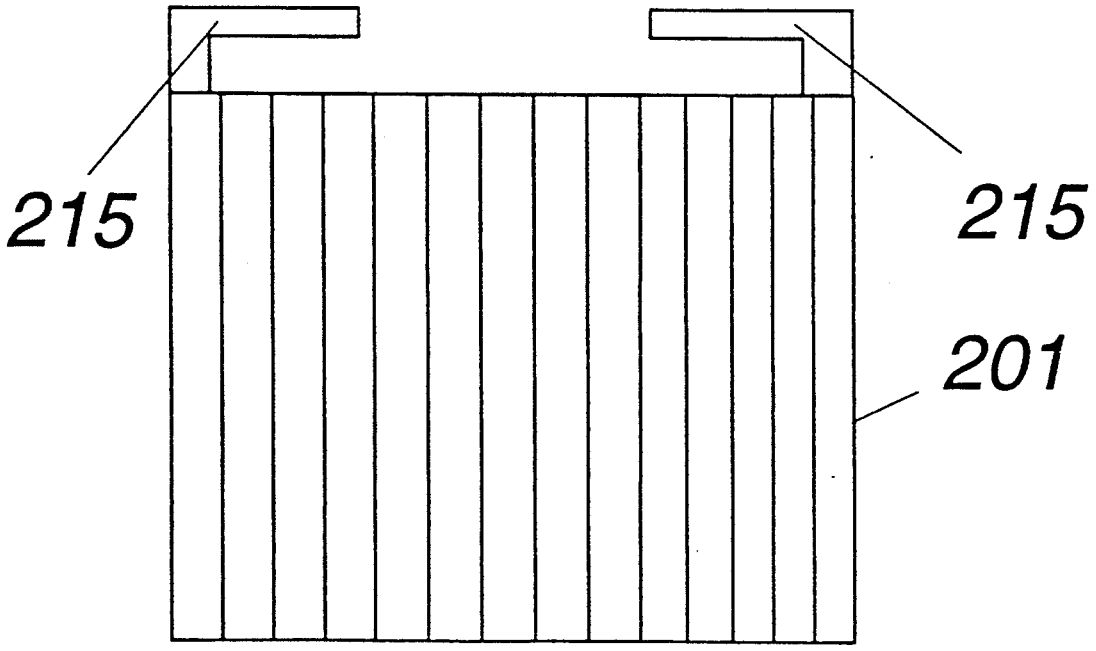
FIG. 5B is a front view of the cap member illustrating the C-shaped bracket means.
Figure 6:
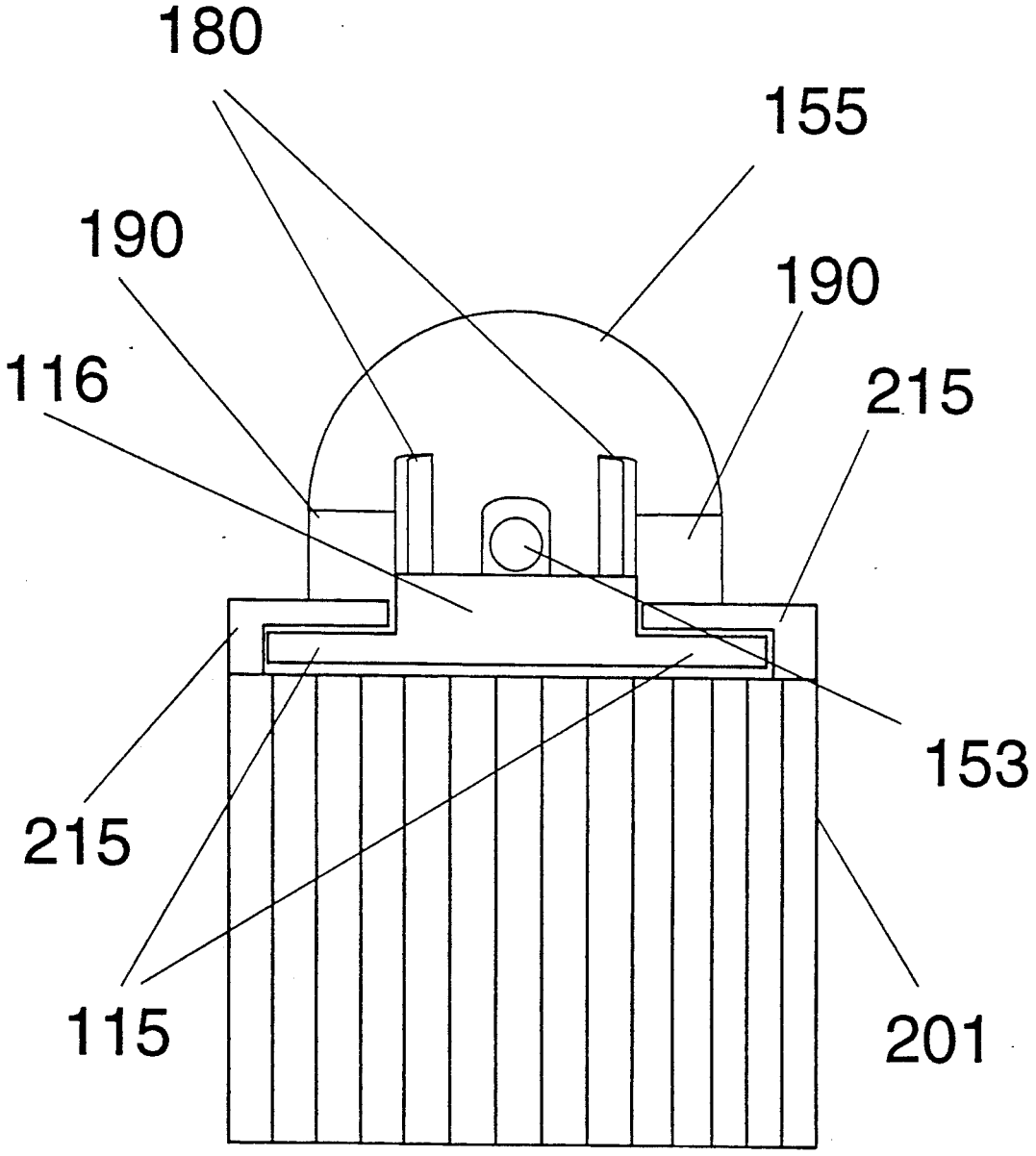
FIG. 6 is a front view of the sprayer showing the nozzle member and the cap member in slideable connection.

To achieve slideable attachment as described above, nozzle member 100 and cap member 200 are provided with appropriately corresponding attachment means. Preferably, control member 110 and cap member 200 are slideably attached in a manner to minimize the distance which the chemical product to be diluted must travel to reach product aperture 111. Thus a preferred embodiment of attachment means are illustrated in FIGS. 5A, 5B and 6. In this embodiment control member 110 is constructed such that planar tracks 115 extend laterally from a central member 116 thereof. Cap member 200 is preferably provided with opposing L-shaped brackets 215 to form a C-shaped bracket or clip thereon. As shown in FIGS. 6, 7 and 8, planar tracks 115 are slideably disposable in L-shaped brackets 215. Clips 215 and tracks 115 are appropriately dimensioned to cause sufficient compressive force upon sealing means 140 and 141 to create an effective seal, while allowing slideable movement of control member 110 in relation to cap member 200.

As also shown in FIG. 5A, 6, 7 and 8, control member 110 preferably has substantially vertical guide means 180 disposed thereon to assist in guiding water exiting outlet means 153 over product aperture 111. Control member 110 is also provided with mechanical abutment means 190 to control the slideable motion of control member 110 in relation to cap member 200.

In another embodiment as depicted in FIG. 9, sprayer 300 comprises a control member 310 in slideable connection with cap member 320. In this embodiment, control member 310 slides independently of nozzle member 330. Nozzle member 330 and cap member 320 can thus be formed of an integral piece of material (preferably a thermoplastic) to form a sprayer body 305. In this regard, cap member 320 refers to the lower portion of sprayer body 305 while nozzle member refers to the upper portion of sprayer body 305.

Figure 11:
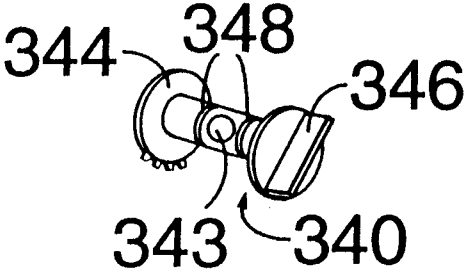
FIG. 11 is a perspective view of a flow control means.
Figure 10:
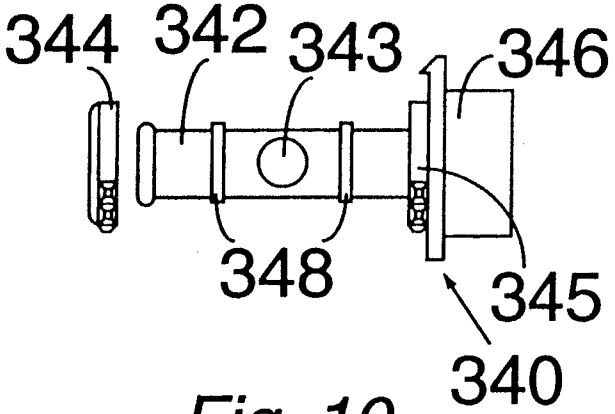
FIG. 10 is a front view of an embodiment of a flow control means.

Preferably, control member 310 includes a means for controlling the position of control member 310 such as geared portion 311, teeth 312 of which preferably cooperate with flow control means 340. As seen in FIGS. 10 and 11, flow control means 340 preferably comprises a lateral portion 342 having a passage 343 therethrough operable to control water flow. At each distal end of lateral portion 342, a motion transfer means such as gear means 344 and 345 is preferably attached.

Preferably, at least one of gear means 344 and 345 (gear means 344 in FIG. 10) is removably attachable (such as by a "snap-on" connection) to facilitate construction of sprayer 300. During construction of sprayer 300, lateral portion 342 of flow control means 340 is placed into an appropriate bore hole (not shown) in sprayer body 305 and gear means 345 subsequently connected.

As shown in FIGS. 10 and 11, flow control means 340 also preferably include means for facilitating control thereof such as extended member 346. Extended member 346 may also act as a means for indicating the position of flow control means 340.

Figure 13:
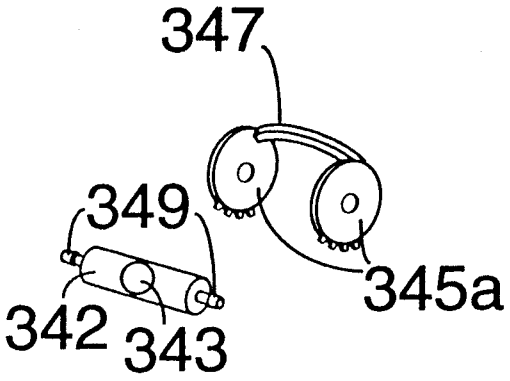
FIG. 13 is a perspective view of another embodiment of a flow control means.
Figure 12:
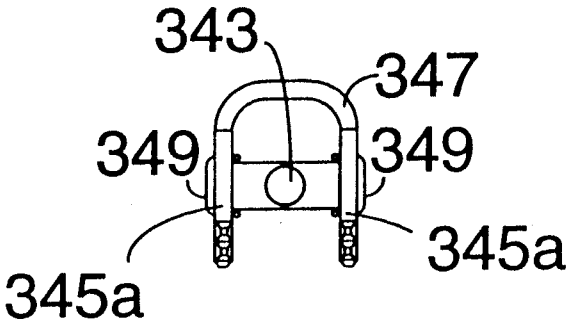
FIG. 12 is a front view of another embodiment of a flow control means.
Figure 14:
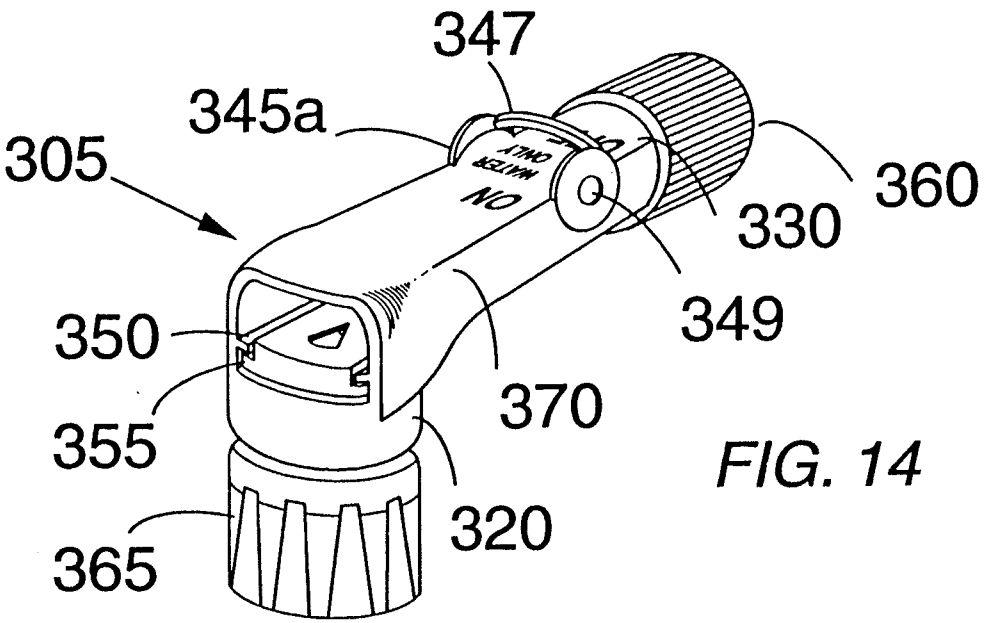
FIG. 14 is a perspective view of an embodiment of a sprayer including a protective hood means.

In FIGS. 12 and 13, a second embodiment of a flow control means 340 is illustrated. In this embodiment flow control means 340 is provided with a bar means 347 in operative connection with gear means **345*a* for facilitating positioning of flow control means 340. As illustrated in FIG. 14, bar means 347 also provides a means for indicating the position of flow control means 340**.

At each side of passage 343, lateral member 342 is preferably provided with sealing means such as elastomeric rings 348 to prevent unwanted leakage of water. As shown in FIGS. 12 and 13, lateral member is also preferably provided with connecting means 349 at distal ends thereof to facilitate connection of gear means 344 as depicted in FIG. 10 and gear means **345*a* as depicted in FIG. 13**.

Figure 15:
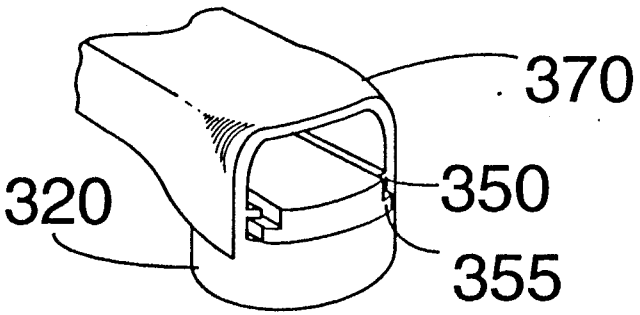
FIG. 15 is a perspective view of an embodiment of a sprayer showing attachment means for a control member.
Figure 17:
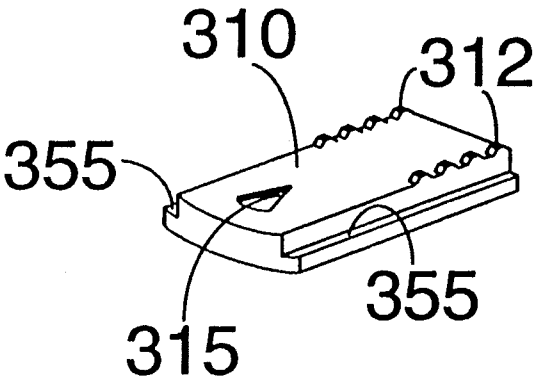
FIG. 17 is a perspective view of an embodiment of a control member.

As shown in FIG. 15, cap member 320 of sprayer 300 is preferably provided with attachment means to achieve slideable attachment of control member 310. In a preferred embodiment, cap member 320 is provided with L-shaped brackets 350 to form a bracket or clip thereon. In this embodiment control member 310 is constructed with corresponding attachment means such as planar tracks 355 extending laterally therefrom as best seen in FIGS. 16 and 17.

Figure 16:
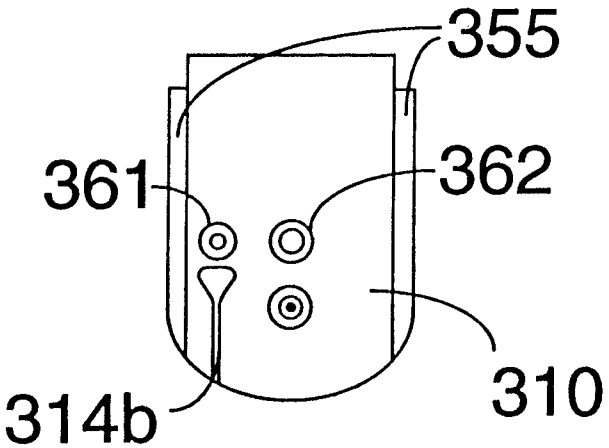
FIG. 16 is a bottom view of an embodiment of a control member.

FIG. 16 illustrates a bottom view of an embodiment of control member 310. As shown, control member 310 includes a product channel 313 and a vent means. Vent means may comprise a channel **314*a* passing vertically through control member 310 as depicted in FIG. 9 or alternatively may comprise a channel 314*b* passing lengthwise through control member 310 as shown in FIG. 16 to provide communicative connection between the interior of a product container and ambient pressure when control member 310 is in a position allowing product to exit a container as described for sprayer 1**.

Sprayer 300 operates similarly to sprayer 1 discussed above. In the first position, water from a hose (not shown) flows through passage 343 to direct the exiting stream of water over product aperture 315 (as best illustrated in FIGS. 9 and 17), thereby creating a negative pressure gradient and causing chemical product in the interior of container (not shown) to be drawn through a product tube and exit product aperture 315 as described for sprayer 1.

In a second position, control member 310 is slid longitudinally relative to cap member 320. As described for sprayer 1, product channel and vent channels are no longer in alignment in this second position. Sealing means 361 and 362 such as elastomeric rings disposed between cap member 320 and the base of control member 310 effectively seal the contents of a container and prevent leakage to the surrounding environment. Sealing means 361 and 362 may be disposed in well like depressions formed in control member 310 as depicted in FIG. 16.

In a preferred embodiment, flow control means 340 and control member 310 are interrelatedly and connectively operative via a connective means such that the operation of flow control means 340 simultaneously effects positional control of control member 310. This interrelated operation of flow control means 340 and control member 310 enables simultaneous opening and closing of water flow and product flow via a single controlled motion. Such an embodiment is depicted in FIG. 9 in which gear means 345 is shown to cooperate with control member 310 via geared teeth 312 of control means 310 to effect simultaneous control of flow control means 340 and control member 310.

As also described in connection with sprayer 1, control member 310 can be slid to a third intermediate position in which product is sealed within its container, but carrier water is allowed to pass through passage 343 in flow control means 340. This result is easily accomplished by appropriate placement of vent channel 314*a* and product channel 313 as related to the rotary motion of flow control means 340 and passage 343 located therein.

Referring to FIG. 14, hose end attachment means 360 and container attachment means 365 are preferably rotatably connected nozzle member 330 and cap member 320 of sprayer body 305, respectively. Sprayer 300 also preferably includes a means for preventing errant spraying in the form of hood means 370 as shown in FIGS. 14 and 15.

The simplicity of the present design allows molding of sprayer body 305, control member 310 and flow control means 340 in a single mold, thereby reducing cost considerably over existing designs (approximately 8–10%). Moreover, the top of sprayer body 305 is suitable for direct printing and/or application of information including operating instructions. The bar means 347 of flow control means 340 enables easy operation of sprayer 300 with a single hand, a significant improvement over designs of sprayers presently on the market which require two hands to operate.

Figure 18:
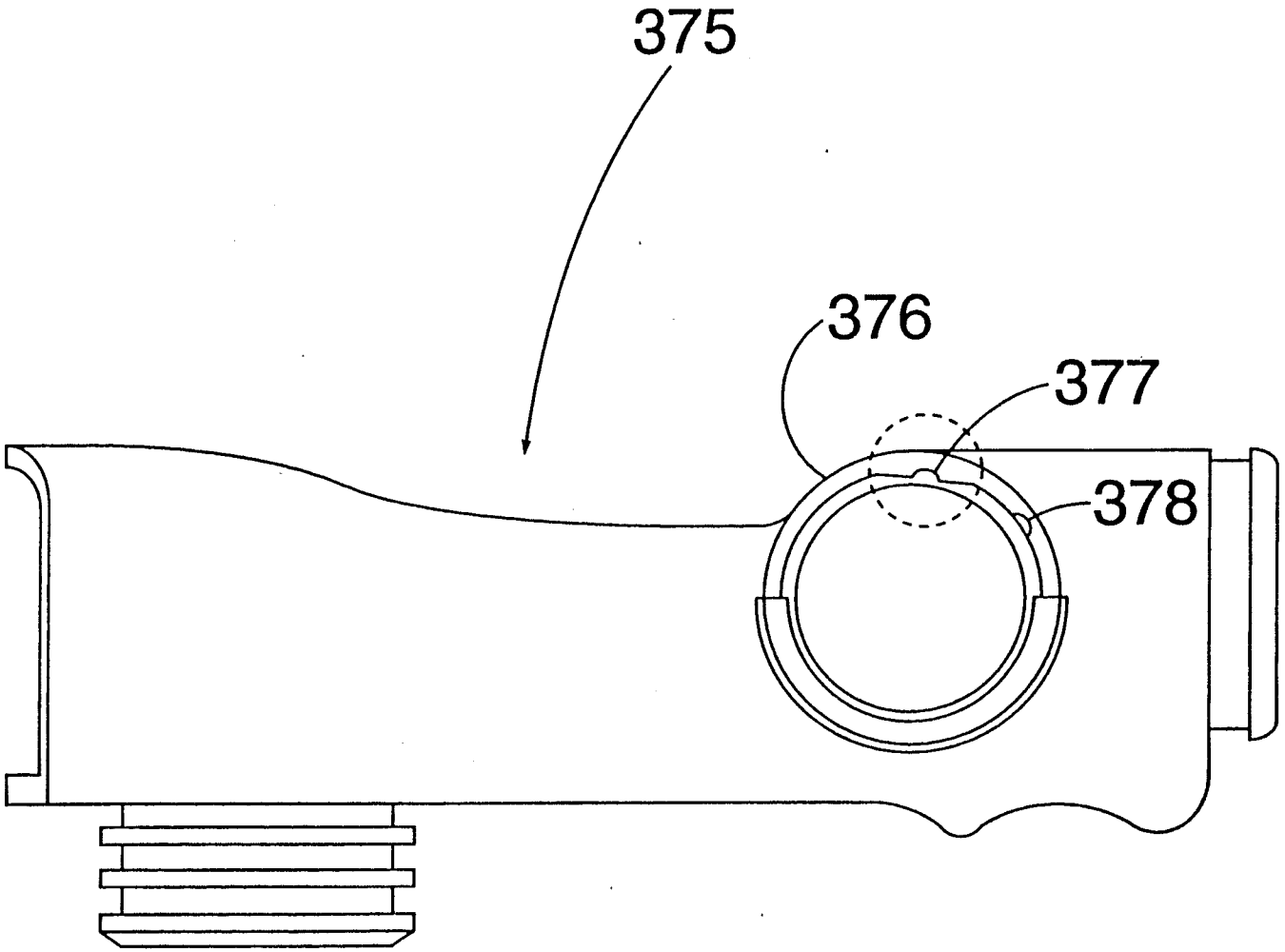
FIG. 18 is a side view of an embodiment of a sprayer showing a flow control member in cross section.
Figure 18A:
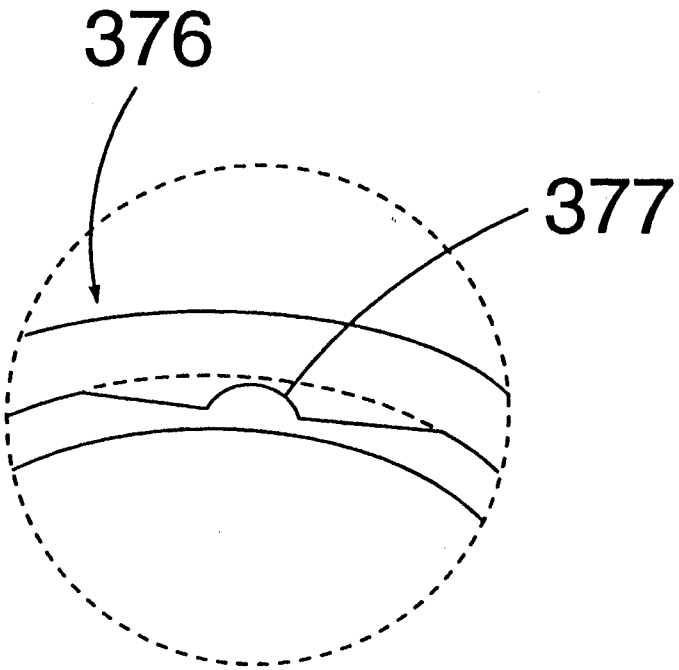
FIG. 18A is a side view of a positioning means.

Another embodiment of the present invention is illustrated in FIGS. 18 through 20A. In this embodiment, flow control member 376 of sprayer 375 is preferably provided with a position indication means such as valve nipple 377. Valve nipple 377 cooperates with detent 378 to accurately position control member 376. An enlarged illustration of valve nipple 377 is provided in FIG. 18A. Preferably there are three detents 378 (only one of which is shown in FIG. 18) corresponding to the three sprayer positions discussed above.

Figure 19:
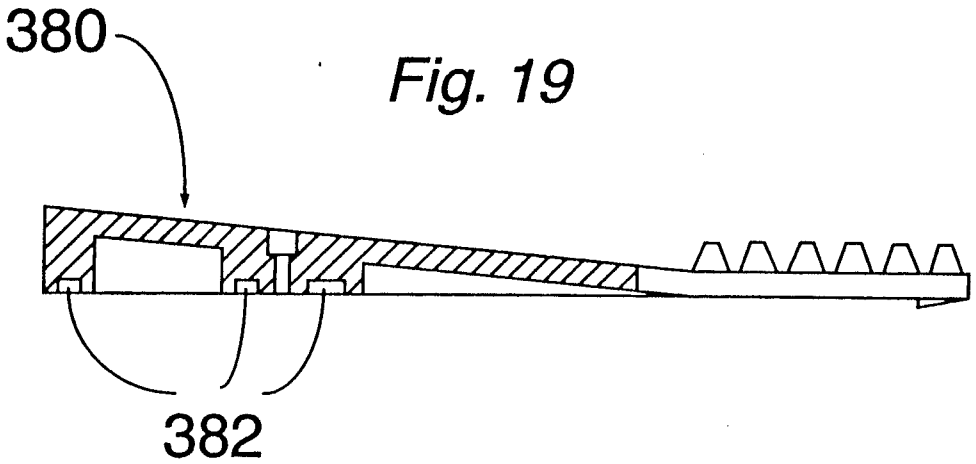
FIG. 19 is a side view of a control member.
Figure 19A:
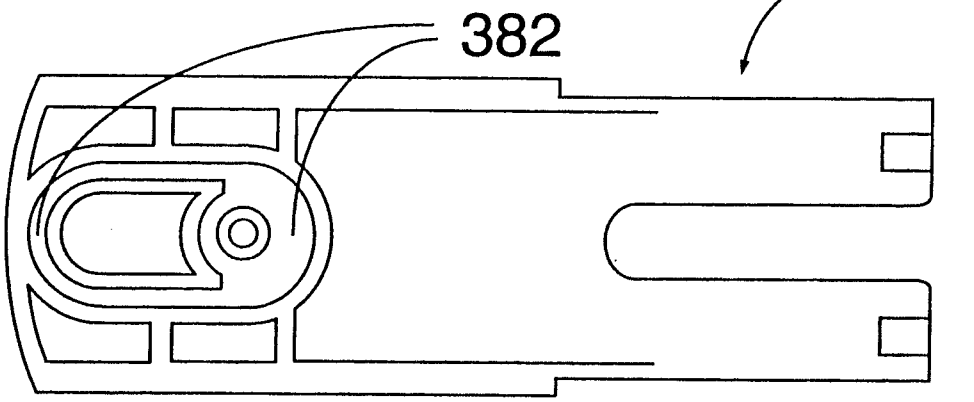
FIG. 19A is a bottom view of a control member.
Figure 19B:
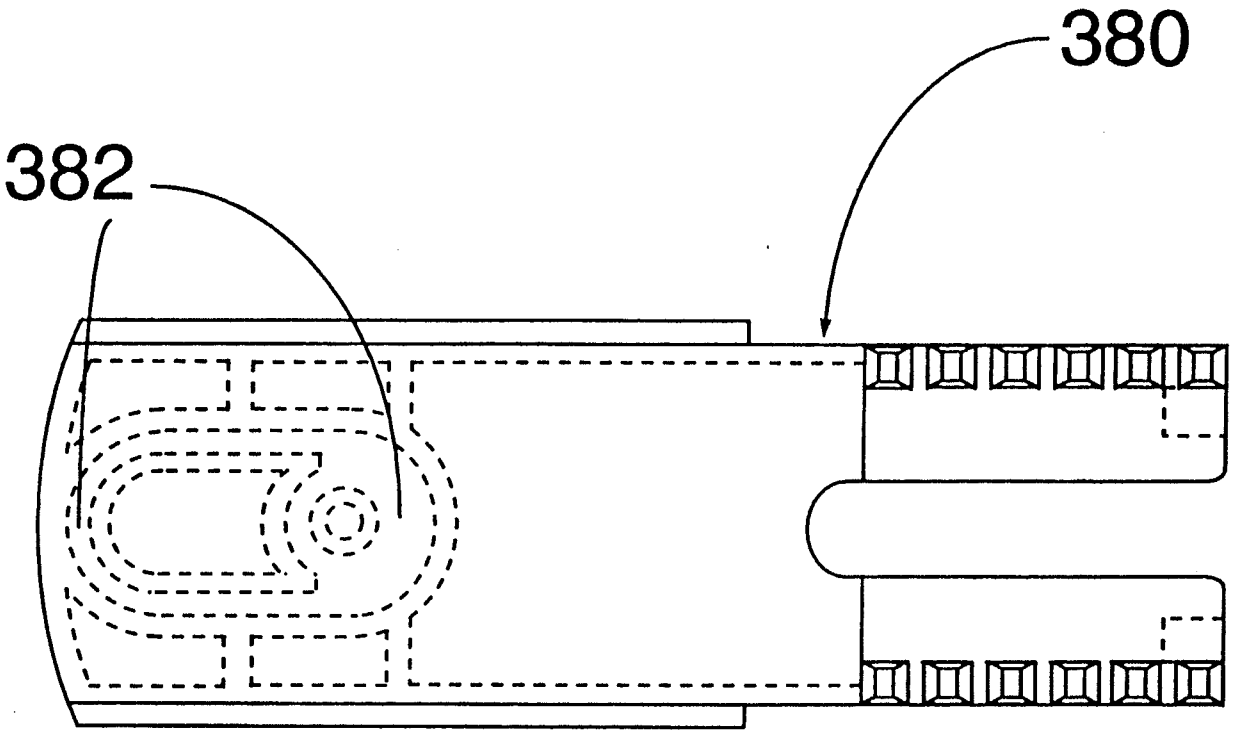
FIG. 19B is a top view of a control member.
Figure 20:
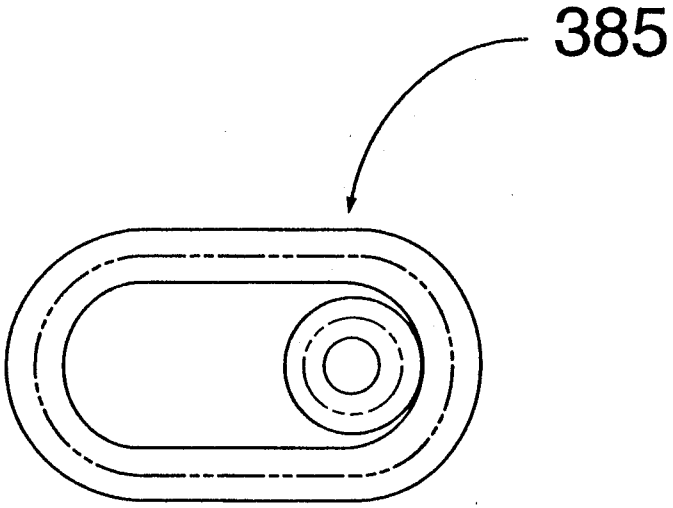
FIG. 20 is a top view of a sealing means.
Figure 20A:
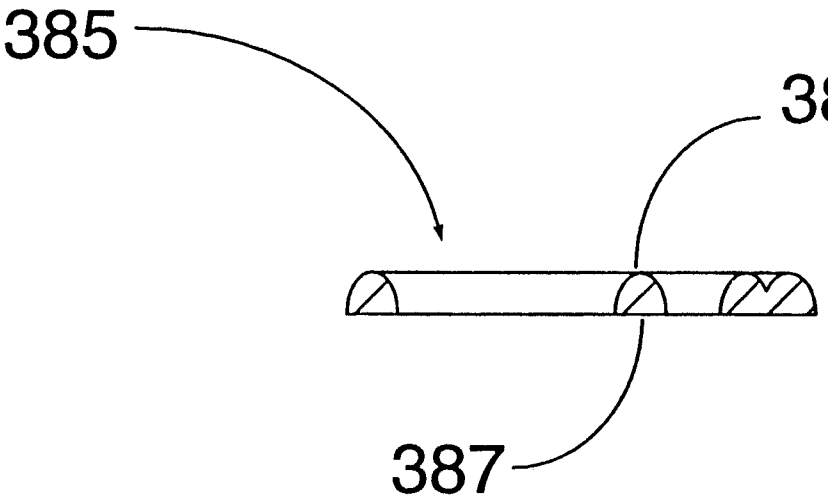
FIG. 20A is a side cross sectional view of a sealing means.

In FIGS. 19, 19A and 19B, a preferred embodiment of a control member 380 is illustrated in a side cross-sectional view, a bottom view and a top view, respectively. In this embodiment, control member is provided with depression 382 for receiving sealing means 385 as illustrated in FIGS. 20 and 20A. Sealing means 385 is preferably constructed of an elastomeric material such as santoprene. Sealing means 385 is provided with a rounded surface 385 and a substantially flat surface 387. It has been discovered that this construction provides a better seal that can be accomplished with prior art sealing means such as common O-rings.

Figure 21:
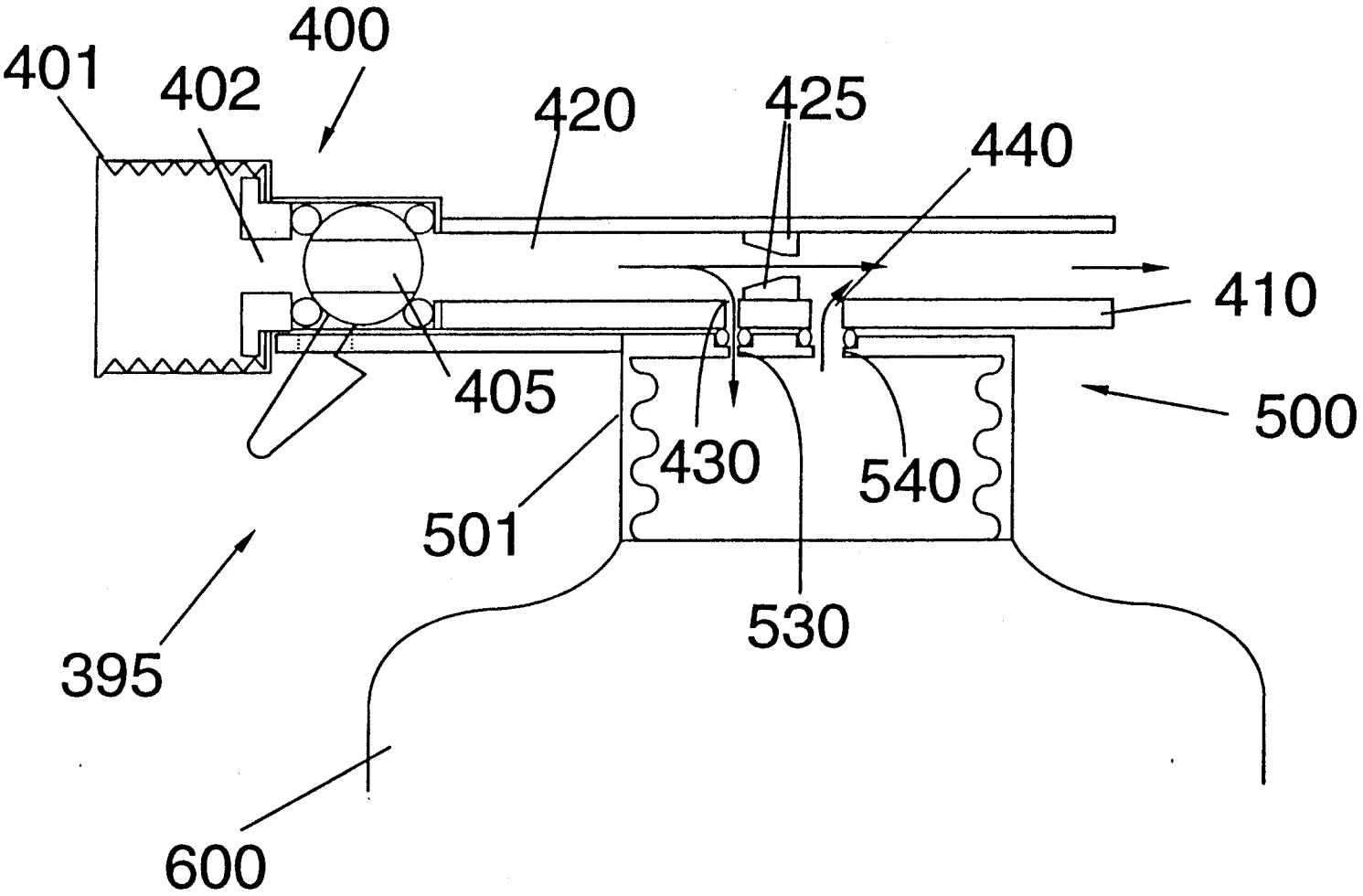
FIG. 21 is a side, cross-sectional view of a sprayer for wettable powders.

Still another embodiment of the present invention comprising a sprayer 395 for use with soluble solids such as wettable powders is illustrated in FIG. 21. Sprayer 395, similar to sprayer 1, comprises an upper or nozzle member 400 and a lower or cap member 500. Nozzle member 400 includes a hose end attachment means 401. Cap member 500 includes a container attachment means 501. Container attachment means 501 is attachable to container 600, the interior of which is capable of holding a wettable powder chemical product to be dissolved, diluted and sprayed. Preferably, container attachment means 501 is permanently and sealingly attached to container 600. Hose end attachment means 401 is removably attachable to a hose end (not shown) for supply of a carrier stream of fluid.

Sprayer 395 further comprises a control member 410 in operative connection with nozzle member 400 and slideably disposed above container attachment means 501. Forwardly located control member 410 includes a product outlet aperture 440 and a carrier stream (water) inlet port 430 disposed therein.

When sprayer 395 is in a first position as illustrated in FIG. 21, a carrier stream from a hose (not shown) preferably exits outlet 402 in hose end attachment means 401 to a flow control means such as ball valve 405. Upon exiting passage 411 in ball valve 405, the water carrier stream enters passage 420 of control member 410. Passage 420 includes a flow control means such as bushing 425 that directs a portion of the carrier stream through inlet port 430 in control member 410 and through a corresponding inlet channel 530 in cap member 500 into container 600 to dissolve and dilute the wettable chemical powder therein. The remainder of the carrier stream passes through bushing 425 to exit passage 420. After a sufficient amount of the carrier stream has been diverted into container 600 to fill container 600, continued entrance of a portion of the carrier stream into container 600 causes a substantially equal portion of product solution to exit product aperture 440 in control member 410 which is in communicative connection with corresponding product channel 540 in cap member 500. The exiting product solution enters that portion of the carrier stream exiting passage 420 to be sprayed upon a desired target. In respects other than the manner in which the product solution is introduced to into the carrier stream exiting the sprayer, sprayer 395 operates substantially as described above for sprayer 1.

As will be appreciated from the discussion of sprayer 1 above, control member 410 and cap member 500 are slideably attached such that in a second position (not shown) control member 410 is slid longitudinally rearwards relative to cap member 500. In this second position, ball valve 405 is in a closed position and product aperture 440 and product channel 540 as well as inlet port 430 and inlet channel 530 are no longer in alignment. Sealing means disposed between container attachment means 501 and control member 410 effectively seal the contents of container 600 and prevent leakage to the surrounding environment. Such sealing means are preferably disposed in well like depressions surrounding product channel 540 and inlet channel 530, respectively. Preferably, a third position is also possible in which ball valve 405 is open but product aperture 440 and product channel 540 and inlet port 430 and inlet channel 530 are not aligned. This third position allows spraying of substantially pure carrier stream fluid.

As also discussed in connection with sprayer 1, in a preferred embodiment, ball valve 405 and control member 410 are interrelatedly and connectively operative such that the relative sliding motion of control member 410 relative to cap member 500 simultaneously results in rotation of ball valve 405. This interrelated operation of ball valve 405 and control member 410 enables simultaneous opening and closing of water flow and product flow via a single controlled motion.

While presently preferred embodiments have been described in detail, the invention may be otherwise embodied within the scope of the appended claims.

What is claimed is:

1. An aspiration type sprayer for attachment to a container encompassing a chemical to be diluted by a carrier stream, comprising:

a. a nozzle member, said nozzle member comprising a means for attachment of said nozzle member to a source of the carrier stream and a means for controlling flow of the carrier stream;

b. a cap member in operative connection with said nozzle member, said cap member including a means for attaching said cap member to the container, said cap member having disposed therein a product channel and a vent channel; and c. a control member, said control member including a product aperture and a vent means disposed therein, said control member being slideably connected to said cap member such that said control member can be longitudinally slid to a first position in which said product aperture and said vent means are in substantially linear communicative connection with said product channel and said vent channel, respectfully, thereby allowing the chemical to enter the carrier stream for dilution when the carrier stream passes over the product aperture, said control member also longitudinally slideable to a second position in which said product aperture and said vent means are not in communicative connection with said product channel and said vent channel, thereby substantially sealing the chemical within the container.

2. The sprayer of claim 1 wherein said means for attaching said cap member to the container permanently attaches said cap member to the container.

3. The sprayer of claim 1 further comprising a means for operatively connecting said control member and said carrier stream flow control means to allow simultaneous control of carrier stream flow and product flow.

4. The sprayer of claim 3 wherein said control member is slideable to a third position in which said product aperture and said vent means are not in communicative connection with said product channel and said vent channel, and said carrier stream flow control means is in an open position to allow spraying of substantially pure carrier fluid.

5. The sprayer of claim 1 further comprising means for providing a substantially sealed connection between said control member and said cap member.

6. The sprayer of claim 5 wherein said seal means comprises at least one elastomeric ring.

7. The sprayer of claim 1 wherein a length between a beginning of said product channel and said product aperture is less than ½ inch.

8. The sprayer of claim 7 wherein said length is less than ⅜ inch.

9. The sprayer of claim 8 wherein said length is approximately ¼ inch.

10. The sprayer of claim 3 wherein said means for operatively connecting said control member and said carrier stream flow control means comprises a gear means disposed upon said carrier stream flow control means which operates connectively with another gear means disposed upon said control member.

* * * * *